United States Patent [19]

Nishida

[11] Patent Number: 4,681,058

[45] Date of Patent: Jul. 21, 1987

[54] SMALL WATERCRAFT WITH ASYMMETRICAL BOW PORTION

[75] Inventor: Hiroshi Nishida, Miki, Japan

[73] Assignee: Kawasaki Jukogyo Kabushiki Kaisha, Hyogo, Japan

[21] Appl. No.: 769,711

[22] Filed: Aug. 27, 1985

[30] Foreign Application Priority Data

Aug. 28, 1984 [JP] Japan ..... 59-179012

[51] Int. Cl.[4] ..... B63B 1/00

[52] U.S. Cl. ..... 114/271; 114/56; 114/270

[58] Field of Search ..... 114/270, 271, 145 R, 114/56, 343, 146; 440/38; 446/160–165

[56] References Cited

U.S. PATENT DOCUMENTS 557,052 3/1896 Cole ..... 114/145 R 3,623,447 11/1971 Jacobson ..... 114/270

3,826,220 7/1974 Jacobson .

FOREIGN PATENT DOCUMENTS 359304 3/1906 France ..... 114/56

54-30197 9/1979 Japan .

WO85/01486 4/1985 PCT Int'l Appl. ..... 114/270

*Primary Examiner*—Joseph F. Peters, Jr.

*Assistant Examiner*—Paul E. Salmon

[57] ABSTRACT

A small watercraft is provided with a heavy engine and its auxiliary machinery at the fore section of a hull and is designed to be steered by the rider on the rear section of the hull. An outer configuration of the bow portion of the small watercraft, which is to sink below the water surface when the small watercraft floats on the water without the rider, is designed to be asymmetrical to the center line of the hull.

1 Claim, 4 Drawing Figures

SMALL WATERCRAFT WITH ASYMMETRICAL BOW PORTION

FIELD OF THE INVENTION AND RELATED ART STATEMENT

This invention relates to a small hydroplane-like watercraft propelled by water jet injection, etc.

Generally, this kind of watercraft which is often used for sport is sailed at a relatively high speed and is also often quickly turned so that the rider may be sometimes thrown into the water from his watercraft.

Additionally, because of its own remarkable compactness, the watercraft is difficult to keep balance of the watercraft on the water. On the other hand, the very delicate steering associated with the watercraft having a type of ship which requires the rider to have the sense of balance enhances it value in sport competition with others for an excellent drive technique.

It is desirable that a small watercraft be designed to circle automatically around the point of falling of the rider if he should fall onto the water. For this purpose, an automatic turning device has been proposed, which is designed to automatically control the steering nozzle in jet propelling equipment into a fixed direction when the rider should let go his hold of the handles so that the watercraft circles automatically around the point of falling by energizing to rotate the fitting board having integrally the handle bars for steering the small watercraft in an either steering direction by means of a spring.

In this case, however, many kinds of parts such as a spring, etc., which are extremely hard to be assembled, are required, and also a certain force is constantly exerted to the handles by means of the spring, which causes the rider to give extra efforts in normal sailing and to become fatigued while sailing.

OBJECT AND SUMMARY OF THE INVENTION

The object and purpose of the invention is to eliminate the aforesaid various drawbacks and to provide a small watercraft designed not to require many parts at all and to circle automatically around the point of falling when the rider should fall onto the water.

To achieve the aforementioned object, a small watercraft according to the invention, which installs an engine and its auxiliary machinery of heavy weight at the fore section of the hull, and is designed to have the rider on the rear section of the hull for steering, is characterized in that an outer configuration of the bow portion of the small watercraft, which is to sink below the water surface when the small watercraft floats on the water without the rider, is designed to be asymmetrical to the center line of the hull.

This kind of watercraft is provided with an engine and its auxiliary machinery of heavy weight at the fore section of the hull, and is designed to have the rider on the rear section of the hull for steering, so that the bow portion is to partly sink below the surface of the water without the rider to have a trim by the bow. After the rider gets on and starts the ordinary sailing, the bow portion floats up to have a trim by the stern, which permits a sailing at a high speed with small wave-making resistance.

Namely, there is a difference between the common big motorboat and the small watercraft in that, with the small watercraft, its attitude in sailing is quite different from that just in floating on the water surface without the rider.

When the rider falls onto the water from his watercraft while sailing, because of an engine and its auxiliary machinery of heavy weight mounted on at the fore section of the hull, the bow portion partly sinks below the water surface and has a trim by the bow. That is to say, the bow portion formed on purpose asymmetrically according to the invention results in lowering it under the water surface.

When the samll watercraft continues sailing as it is, and the water streams strike it, because the bow portion of the hull is asymmetrical to the center line of the hull, the lateral components of the forces applied onto the right and left sides are different. That is, because the lateral component of the force to the much obliquely sliced side of the hull becomes larger, the watercraft turns toward the less sliced side, resulting in the watercraft's automatically circling around the rider who fell into the water.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF PREFERRED EMBODIMENT

Figure 1:
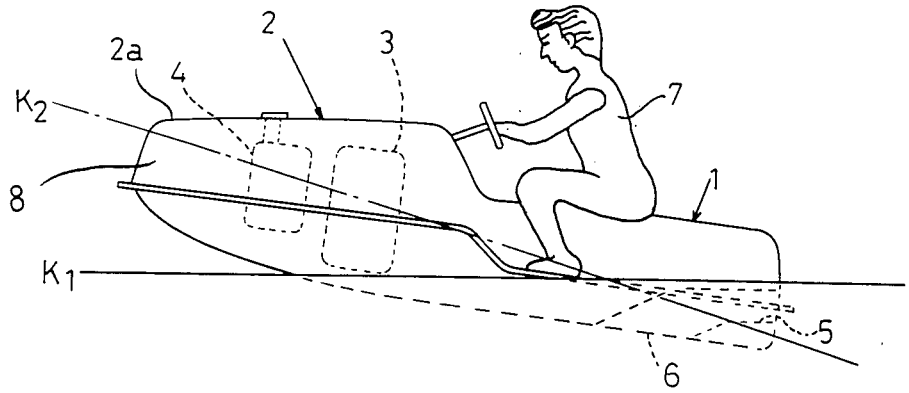
FIG. 1 is a side view of a small watercraft according to the invention.

In FIG. 1, a small watercraft is provided with an engine 3 and its auxiliary machinery 4 including a fuel tank at the fore section of a hull 2. Water sucked from an inlet 6 by means of an impeller (not showing in the figure) is pressurized and jetted out from an outlet of water jet 5, the reaction of which enables the small watercraft to sail. 7 is the rider. K1 is a draft line in ordinary sailing while K2 is one when only the small watercraft floats on the water surface without the rider 7 (for example, when the rider 7 has fallen into the water while sailing).

This means that, without the driver, the hull 2 inclines downwards to the front because of the heavy engine 3 and auxiliary machinery 4 installed at the fore section of the hull 2, which in turn results in a bow portion 8 partly sunk below the water surface.

Figure 2:
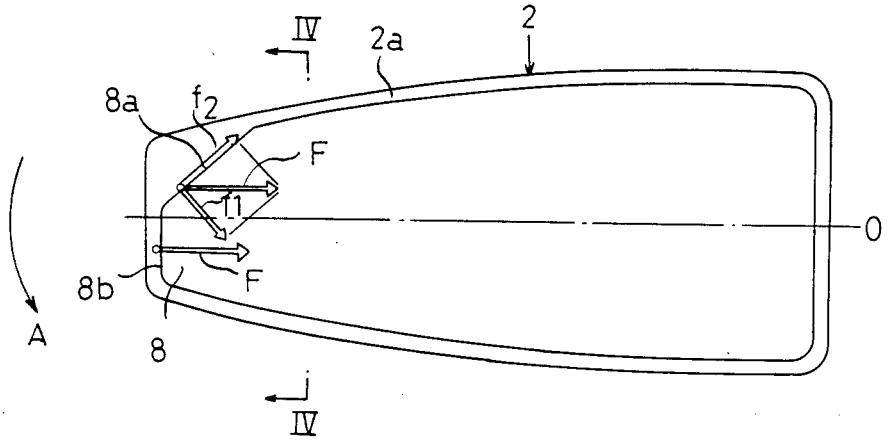
FIG. 2 is a plan view of the hull showing only the outline.

As shown in FIGS. 2, the bow in a front upper section of the hull 2 is asymmetrical to the center line 0 of the hull 2. In the embodiment according to the invention, the front face of the right side **8*a* is obliquely sliced off in a larger degree than that of the left side 8*b***.

Figure 3:
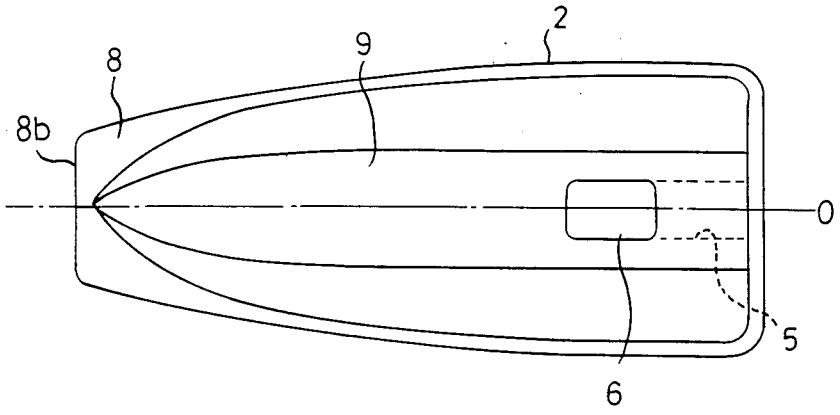
FIG. 3 is a bottom plan view of the hull.

In contrast, as shown in FIG. 3, a bottom 9 is symmetrical to the center line 0 of the hull 2.

With the configuration of the hull 2 of the small watercraft as mentioned above, if the rider 7 should fall into the water from the small watercraft 1, its draft line would change to K2 in FIG. 1. In this case, the engine 3 is kept idling and a little bit of water is injected from the outlet of water jet 5, which allows the small watercraft 1 to continue sailing ahead at a low speed.

Therefore, as shown in FIG. 2, the same magnitude of hydraulic forces F are applied respectively to the right and left sides of the bow portion 8. But the largely sliced off face or large inclination 8*a* on the right side of the bow portion 8 resolves the hydraulic force F into the components f1 and f2; f1 acts normally to the slant surface and f2 tangentially to the surface.

The force component f1 turns the hull 2 counterclockwise, i.e. in the direction of the arrow A in FIG. 2, while the small inclination 8*b* creates a correspondingly negligible magnitude of resolved components of force to rotate the hull 2 both clockwise and counterclockwise on the left side of the bow portion 8.

As the result, the small watercraft circles counterclockwise at an extremely low speed around the rider who has fallen into the water in sailing.

Of course, if the large and small angles of the inclination on the right and left front sides of the bow portion 8 shown in FIG. 2 are replaced with each other, the small watercraft results in clockwise circling. A free choice for aforesaid directions of the turn is available.

Additionally, the bow portion 8 can be formed integrally with the hull 2 or the asymmetric part (s) or the bow portion 8 separately from the hull 2.

Figure 4:
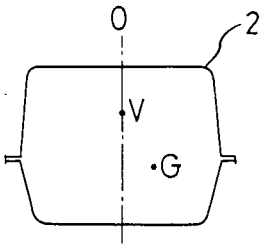
FIG. 4 is a sectional view taken along line IV—IV in FIG. 2, showing that the center of gravity is offset from the center line of the hull toward a broadside.

FIG. 4, showing another embodiment according to the invention, is a sectional view taken along line IV—IV in FIG. 2, where the center of gravity G of the hull 2 of the small watercraft is offset toward a broadside apart from the center line 0 of the hull 2.

In this case, the gravity position described above creates a moment to roll the hull 2 clockwise in FIG. 4, which causes the hull 2 to invariably incline to the right side, so that the front area under the water of the hull 2 on the left side is different from that on the right side (the immersed height in the right side turns out to be deeper that the one in the left side). As a result, a further desirable effect due to the offset gravity can be added to the automatic turning ability of the small watercraft attributable to the longitudinally asymmetrical configuration of the bow portion 8.

Furthermore, the sense of unbalance in sailing caused by the more or less offset of the center of gravity is eliminated as the craft is sailed at higher speeds on the water, because the increased dynamic hydraulic pressure being applied to the bottom leads the posture of the hull 2 to be almost horizontal.

As mentioned above, according to the invention, if the rider should have failed to steer the small watercraft in sailing and have fallen into the water, the hull 2 never fails to turn automatically in a small circle nearly around the point of his falling, so that the rider can easily catch his small watercraft without missing, as well as because of the watercraft's fixed direction of turn in case of the rider's falling, he can sail without troubling other following crafts and intend to save his own craft, by taking into consideration other various conditions over the sailing surface.

In addition, since such particular parts as in the prior art are not required in the embodiment according to the invention, the assembly work is extremely easy and the rider can steer the craft without any effort when sailing.

It will be obvious to those skilled in the art that various changes may be made in the invention without departing from the spirit and scope thereof and therfore the invention is not limited by that which is shown in the drawings and described in the specification but only as indicated in the appended claim.

What is claimed is:

1. A small watercraft comprising a hull having a fore section and rear section, an engine for propelling the watercraft and auxiliary machinery of heavy weight supported at the fore section of the hull, said watercraft being steered by a rider on the rear section of the hull, and wherein said fore section comprises a bow portion which sinks below the water surface when said small watercraft floats on the water without the rider, but does not sink below the water surface when said small watercraft floats on the water with the rider, only said bow portion having an outer surface whose form is arranged asymetrical with respect to the center line of said hull, whereby when the rider is not on the rear section of the small watercraft, it will automatically be propelled by said engine in a circle.

* * * * *